US005628505A

United States Patent [19]

Voss

[11] Patent Number: 5,628,505

[45] Date of Patent: May 13, 1997

[54] APPARATUS FOR STACKING CONTINUOUSLY ARRIVING SHEETS

[75] Inventor: Peter Voss, Jüchen, Germany

[73] Assignee: Jagenberg Papiertechnik GmbH, Neuss, Germany

[21] Appl. No.: 569,879

[22] Filed: Dec. 8, 1995

[30] Foreign Application Priority Data

Dec. 22, 1994 [DE] Germany ..... 44 45 994.7

[51] Int. Cl.[6] ..... B65H 31/12

[52] U.S. Cl. ..... 271/218; 271/189; 414/790.8

[58] Field of Search ..... 271/189, 218; 414/789.5, 790.8, 796.1

[56] References Cited

U.S. PATENT DOCUMENTS

| | | | |
|---|---|---|---|
| 4,949,953 | 8/1990 | Claassen et al. | 271/218 |
| 5,102,117 | 4/1992 | Henn et al. | 271/218 X |

FOREIGN PATENT DOCUMENTS

| | | | |
|---|---|---|---|
| 1230810 | 12/1966 | Germany | 271/218 |
| 3535113 | 4/1987 | Germany . | |
| 3616470 | 6/1987 | Germany . | |
| 3723113 | 1/1989 | Germany . | |
| 3739194 | 6/1989 | Germany . | |
| 147807 | 6/1993 | Japan | 271/218 |
| 2157272 | 10/1985 | United Kingdom | 271/218 |

*Primary Examiner*—Boris Milef

*Attorney, Agent, or Firm*—Herbert Dubno; Andrew Wilford

[57] ABSTRACT

An apparatus for stacking sheets has a conveyor having a downstream end spaced upstream in a horizontal transport direction from a stacking station for delivering the sheets continuously one after the other at a predetermined upper level in the direction to the station and a main platform vertically displaceable in the stacking station between an upper position below the upper level and a lower position. An auxiliary platform below the upper level is formed by a plurality of parallel rods horizontally displaceable in the direction between an extended position in the station above the main platform and a retracted position upstream of the main platform. A plurality of vertically extending separator elements having bent-over upper ends projecting downstream between the rods in the transport direction are and displaceable between a separating position projecting into the station between the auxiliary platform and the upper level and engaged between trailing edges of sheets and a withdrawn position out of the station between the station and the conveyor downstream end. Each element has a vertical length greater than the vertical distance between the auxiliary platform and the upper level.

5 Claims, 8 Drawing Sheets

APPARATUS FOR STACKING CONTINUOUSLY ARRIVING SHEETS

FIELD OF THE INVENTION

The present invention relates to a sheet stacker. More particularly this invention concerns an apparatus for forming stacks of sheets that arrive continuously in an overlapping stream.

BACKGROUND OF THE INVENTION

In a paper mill a continuous strip of paper moving longitudinally at high speed must be transversely cut into individual sheets that must then be piled in individual stacks on pallets or the like. The stacking must be done without interrupting the flow of continuously arriving sheets, so that when a stack is complete it is necessary to get it out of the way and bring a new pallet into place while somehow catching and holding the sheets that arrive during the changeover.

Accordingly U.S. Pat. No. 4,949,953 of E. Claassen describes an arrangement where the pallet is carried on a vertically displaceable main platform, and where a horizontally displaceable auxiliary platform can be moved into position above the main platform to catch the arriving sheets as the full pallet on the main platform is switched for an empty one. L-shaped clamping elements hold the partial stack on the auxiliary platform in place after the empty pallet is raised into position below it so the auxiliary platform can be withdrawn to deposit the stack it carries on the empty pallet, whereupon stacking can proceed as beforehand.

Other similar solutions are described in German 3,535,113 of J. Bodewein (U,.S. equivalent U.S. Pat. No. 4,799,847), 3,616,470 of N. Martini, and 3,723,113 of H. Hohenschutz. All are quite complicated, entailing substantial complex structure, so that they cannot be counted on to perform satisfactorily in the long run.

OBJECTS OF THE INVENTION

It is therefore an object of the present invention to provide an improved sheet-stacking system.

Another object is the provision of such an improved sheet-stacking system which overcomes the above-given disadvantages, that is which is substantially simpler than the prior-art systems.

SUMMARY OF THE INVENTION

An apparatus for stacking sheets has according to the invention a conveyor having a downstream end spaced upstream in a horizontal transport direction from a stacking station for delivering the sheets continuously one after the other at a predetermined upper level in the direction to the station and a main platform vertically displaceable in the stacking station between an upper position below the upper level and a lower position. An auxiliary platform below the upper level is formed by a plurality of parallel rods horizontally displaceable in the direction between an extended position in the station above the main platform and a retracted position upstream of the main platform. A plurality of vertically extending separator elements having bent-over upper ends projecting downstream between the rods in the transport direction are and displaceable between a separating position projecting into the station between the auxiliary platform and the upper level and engaged between trailing edges of sheets and a withdrawn position out of the station between the station and the conveyor downstream end. Each element has a vertical length greater than the vertical distance between the auxiliary platform and the upper level.

Thus with this system the separator elements serve merely to create a gap in the stack forming on the main platform so the auxiliary platform can slide into place and assume the load while the main platform is lowered and the full pallet is exchanged for an empty one. As soon as the auxiliary platform is in place, the separator elements move off and out of the way.

According to a further feature of the invention a housing carrying the platforms and elements has an upstream part between the station and the conveyor downstream end. The housing forms a vertical guide face directed downstream and engaging trailing edges of the sheets in the stack. The vertical face is formed with throughgoing holes through which the auxiliary-platform rods can engage and therebetween with cutouts housing the separator elements. Thus as the auxiliary platform retracts, the stack formed on it is stripped off as it engages the vertical face of the housing, so that this short stack drops down onto the empty pallet that has meanwhile been positioned just below it.

In accordance with further features of the invention an actuator and a stop are provided for vertically displacing the elements between the separating position and a lower intermediate position immediately above the auxiliary platform. Thus the separators move down from a position at the upper level to a position just above the auxiliary platform, whereupon this auxiliary platform is advanced to pick up the sheets above the gap formed by the separators.

It is also possible according to the invention to limit the drop of the sheets being deposited on the auxiliary platform to provide an actuator for limitedly vertically displacing the auxiliary platform. Thus it can follow the formation of a stack on it like the main platform.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
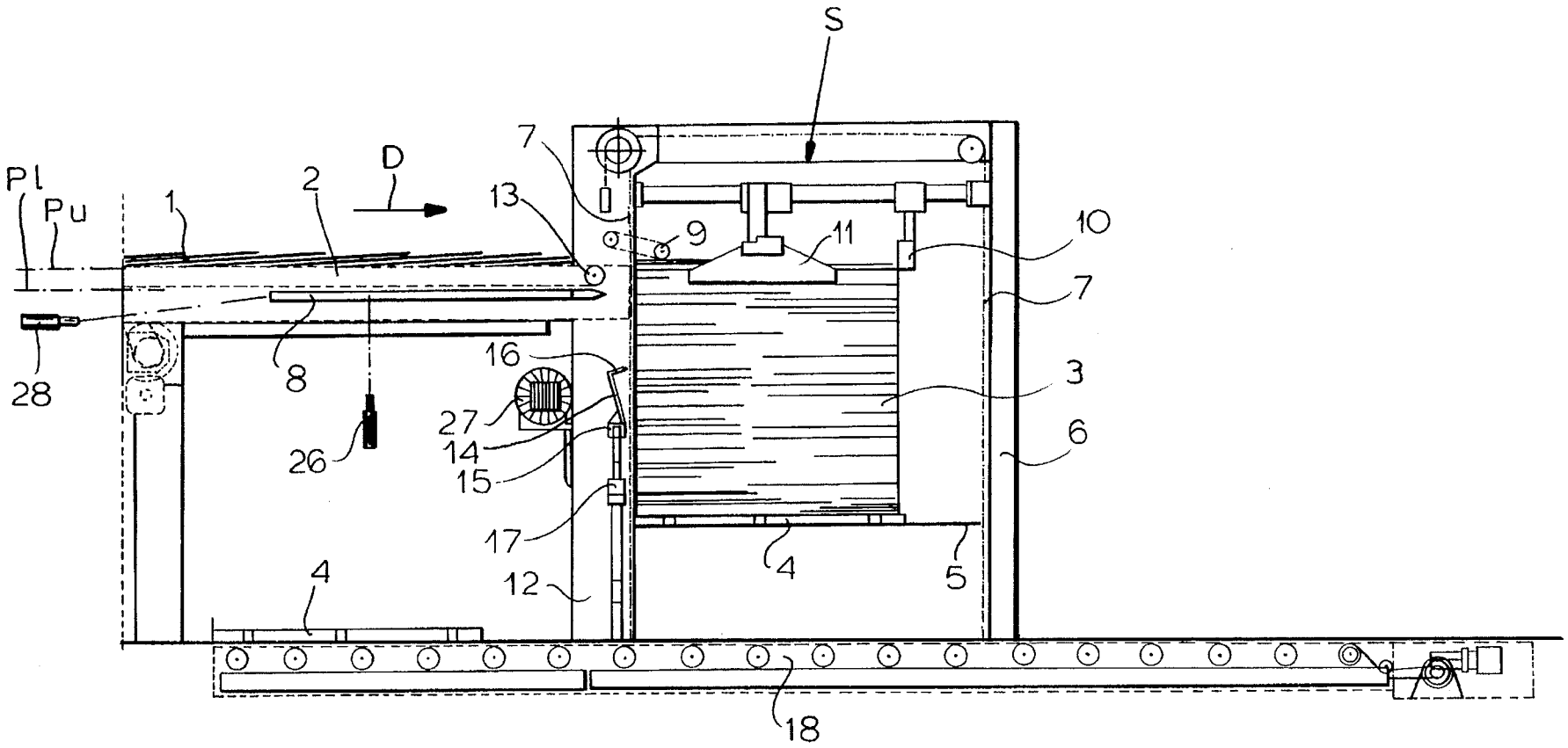
FIG. 1 is a partly diagrammatic and small-scale side view of the apparatus of this invention.

As seen in FIG. 1 the machine according to this invention serves to pile sheets 1 delivered to a stacking station S in a direction D at an upper level Pu by a belt conveyor 2 into stacks 3 atop a pallet 4. A main support platform 5 carrying the pallet 4 can be moved vertically in an apparatus frame 6 by means including a motor 27 and chains or cables 7 from which the platform 5 is suspended. An auxiliary platform 8 formed by a plurality of square-section and pointed rods 21 (see FIG. 8) lies at a lower level Pl slightly below the level Pu and can be moved horizontally as described below by an actuator illustrated schematically at 28. The arriving sheets 1 overlap one another, that is the trailing edge of each sheet 1 lies underneath the leading edge of the following sheet 1, and they are assisted onto the stack 3 by a driven upper feed roller 9. The leading ends of the sheets 1 come to rest against an end stop plate 10 which may vibrate, and the sides of the sheets 1 are kept square by side guides 11 so that the sheets 1 are aligned in the stack 3.

An upstream portion 12 of the machine frame 6 between the station S and the conveyor 2 houses a downstream roller 13 of the conveyor 2 and a plurality of vertically displaceable separator elements 14 formed as L-shaped metal plates each having a bent-over upper end 16 and a lower end fixed to a common traverse 15 that can be raised, lowered, and pivoted about a horizontal axis by a pneumatic actuator 17. A conveyor 18 recessed in the floor underneath the apparatus can carry off the full pallet 4 carrying the stack 3 and bring in an empty pallet 4.

Figure 8:
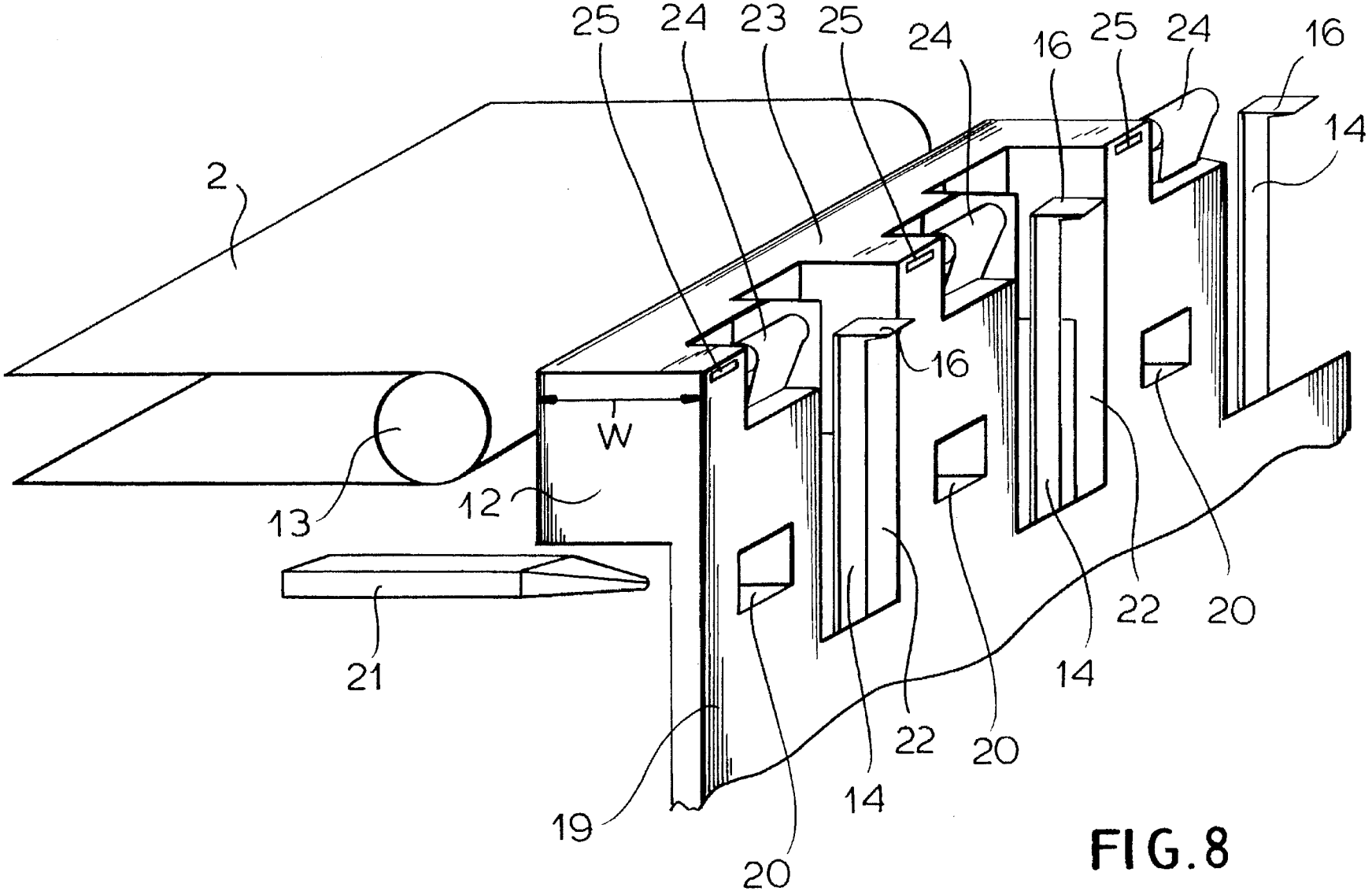
FIG. 8 is a larger-scale perspective view of a detail of the apparatus.

As shown in FIG. 8 the upstream portion 12 of the machine frame 6 has a predetermined width W in the direction D and forms a vertical guide wall 19 that bounds the upstream end of the stacking station S and a short horizontal slide surface 23 over which the sheets 1 move from the downstream end of the conveyor 2 to the station S, with the assistance of pusher belts or rollers 24 recessed into the corner between the surfaces 19 and 23. The wall 19 is formed with vertically open notches or windows 22 in which the separator elements 14 are housed and with throughgoing holes 20 through which the bars 21 of the movable platform 8 can poke. Nozzles 25 of an air-blast system open in the direction D just below the upper surface 23 to ensure that the sheets 1 coming off the surface 23 settle squarely atop the underlying sheets 1 or pallet 4. Unillustrated tagging devices that can insert marker strips between the sheets 1 are housed in the cutouts 22.

The apparatus described above operates as follows:

As shown in FIG. 1 during most of a normal stacking operation the platform 5 is moved slowly downward to keep the top of the stack 3 just below the upper level or plane Pu so that the arriving sheets 1 do not have to drop too far to come to rest on it. Normally a stiff cardboard sheet can drop some 300 mm without damage while a thinner sheet can only drop some 15 mm without damage. Meanwhile the separator elements 14 are in the lower position, the end guide 10 is vibrating to square the stack 3, and the auxiliary support 8 is retracted.

Figure 2:
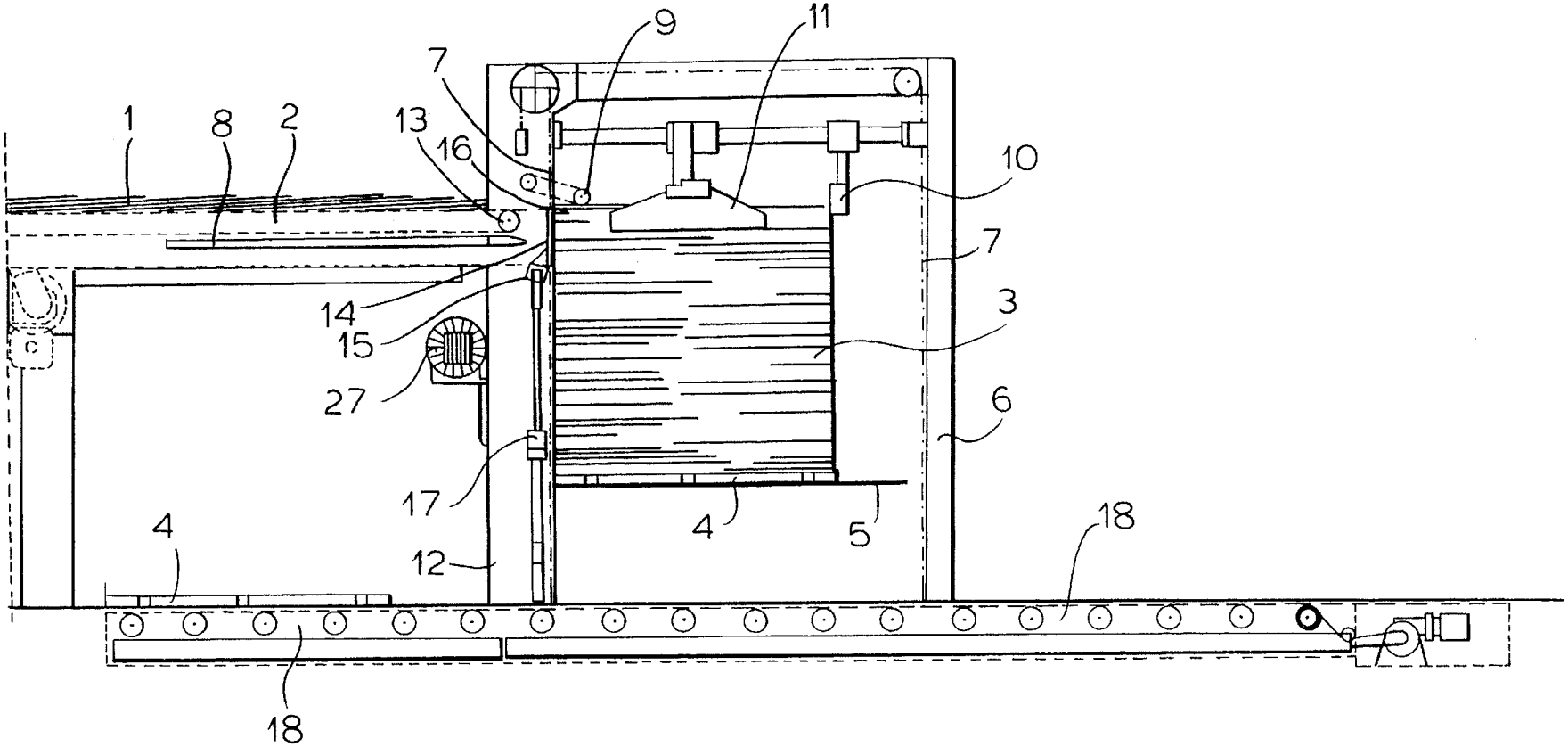
FIGS. 2 through 7 are views like FIG. 1 showing the apparatus in different positions.

Once the stack 3 has reached the desired height as shown in FIG. 2 the separator elements 14 are moved upward so that the ends 16 are level with the plane Pu, and then pivoted inward so that these ends 16 are hooked over the top of the stack 3. The sheets 1 continue to arrive and the top of the stack 3 continues to move downward to an intermediate level between the planes Pu and Pl with the separator ends 16 just above the plane Pl. Meanwhile the machine can be slowed down somewhat, without however stopping the continuous arrival of the sheets 1.

Figure 3:
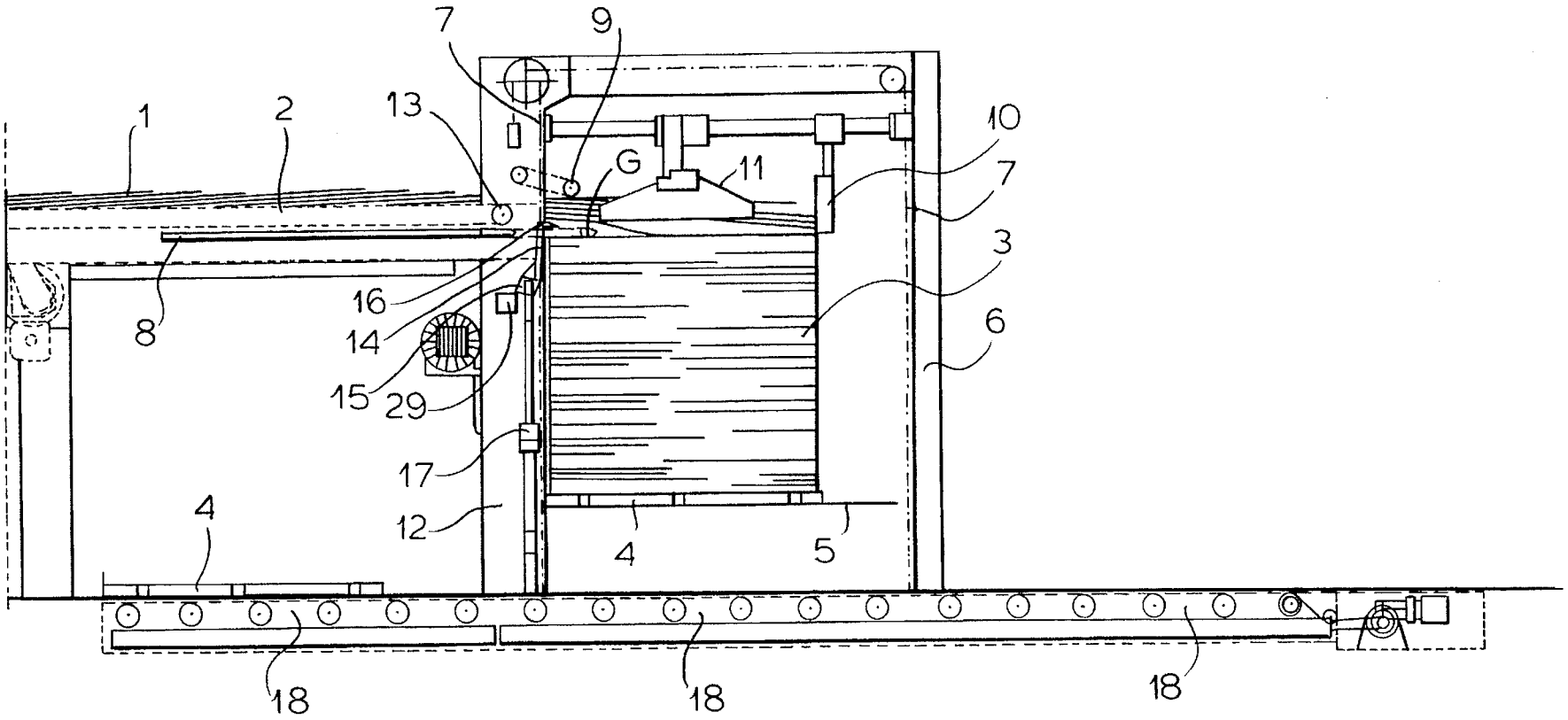
Figure 4:
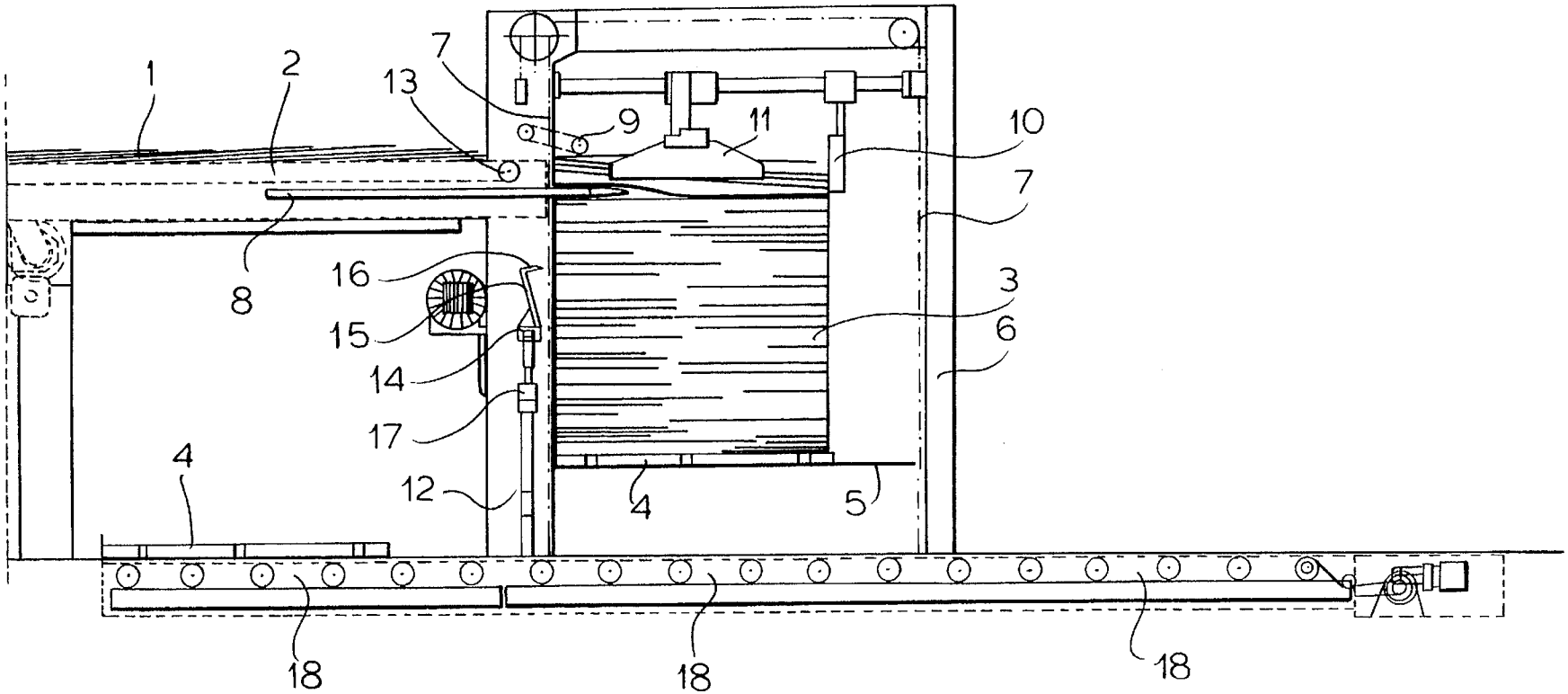

Once this level is reached as shown in FIG. 3 the elements 14 engage a stop 29 and cease moving downward while the stack 3 continues to descend to form a gap G about 40 mm high in the stack 3 aligned with the platform 8. Then as shown in FIG. 4 the rods 21 of the platform 8 are advanced downstream in direction D into this gap G so that all the sheets 1 above the gap G and all subsequently arriving sheets 1 are supported on the platform 8. Vibration of the guide 10 is stopped.

Figure 5:
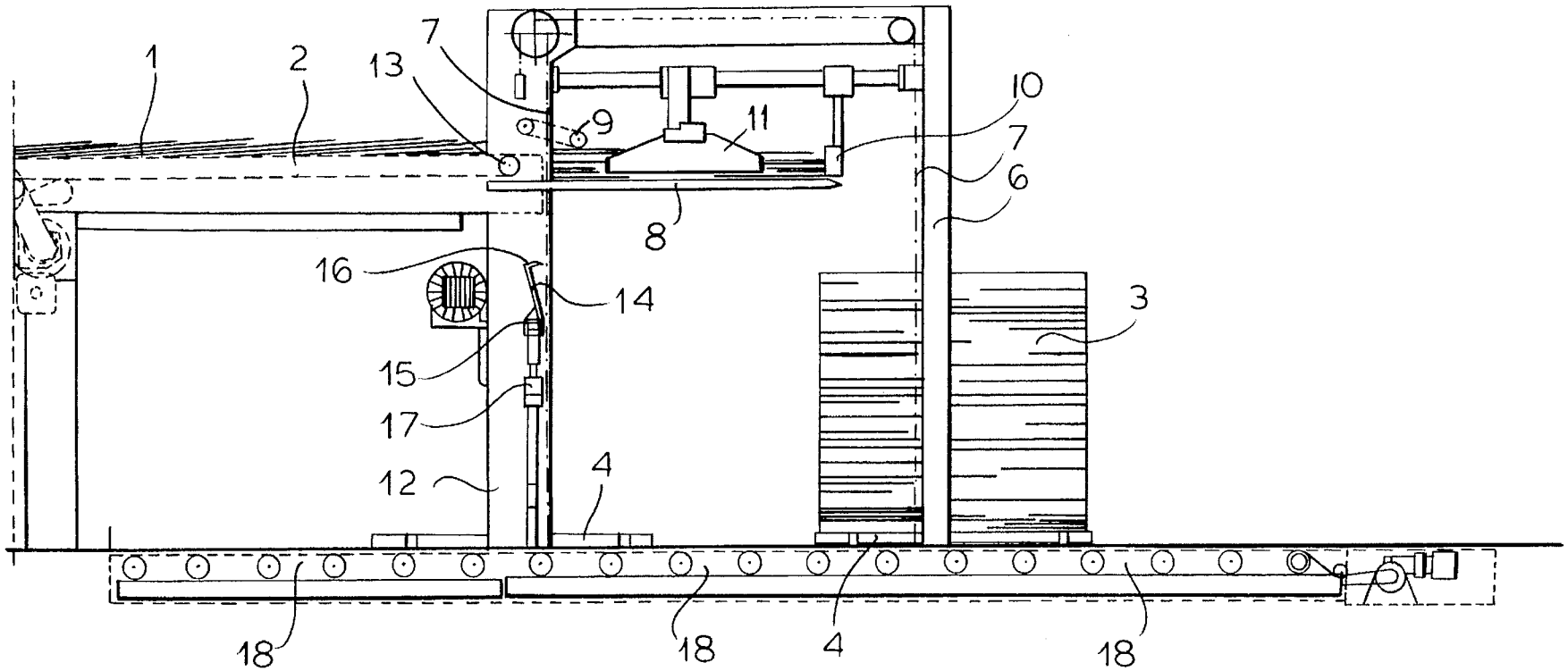

Then as shown in FIG. 5 the platform 5 is rapidly lowered at about 200 mm/s so that the conveyor 18 can carry off the pallet 4 with its stack 3 and synchronously move a new pallet 4 into position in the station S above the lowered platform 5. Meanwhile the continuously arriving sheets 1 pile up on the extended platform 8.

Figure 6:
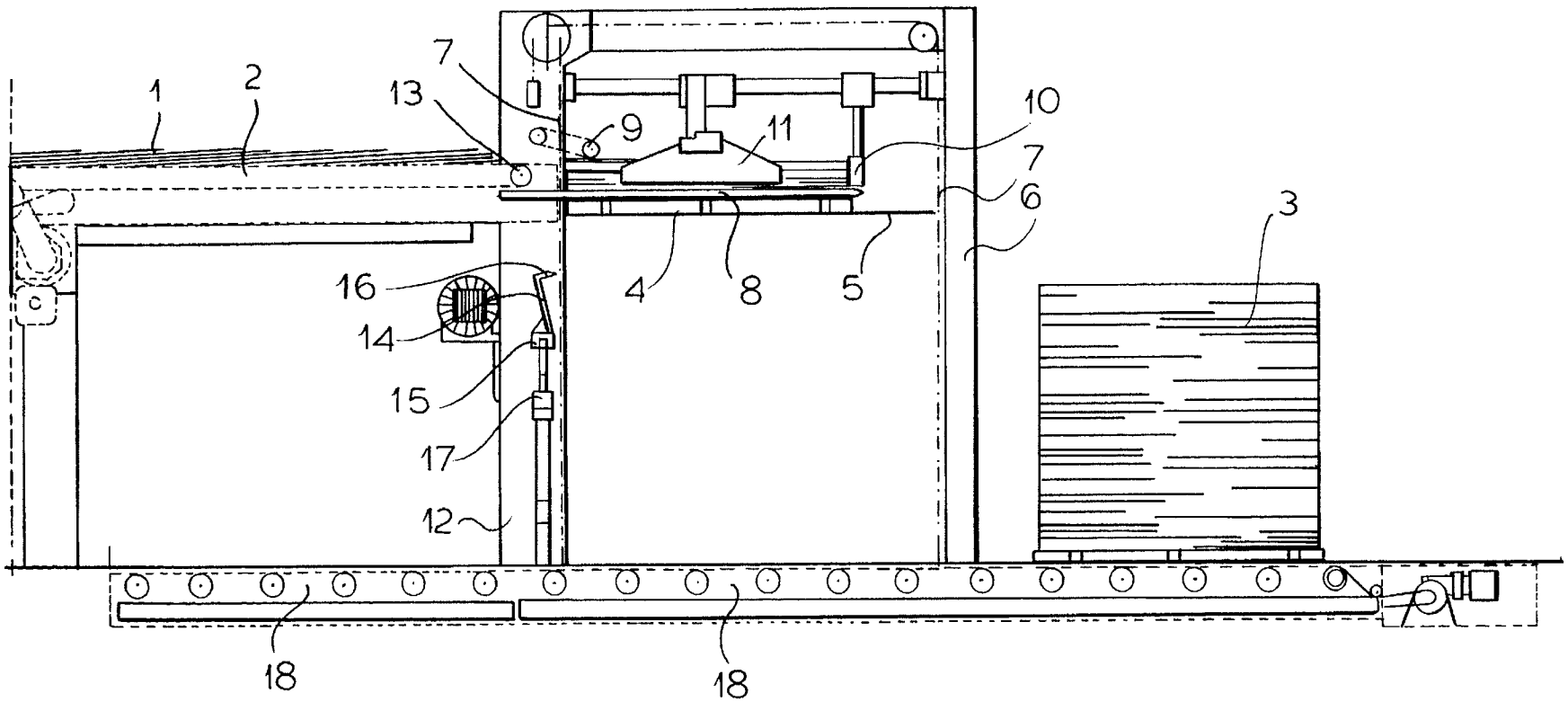
Figure 7:
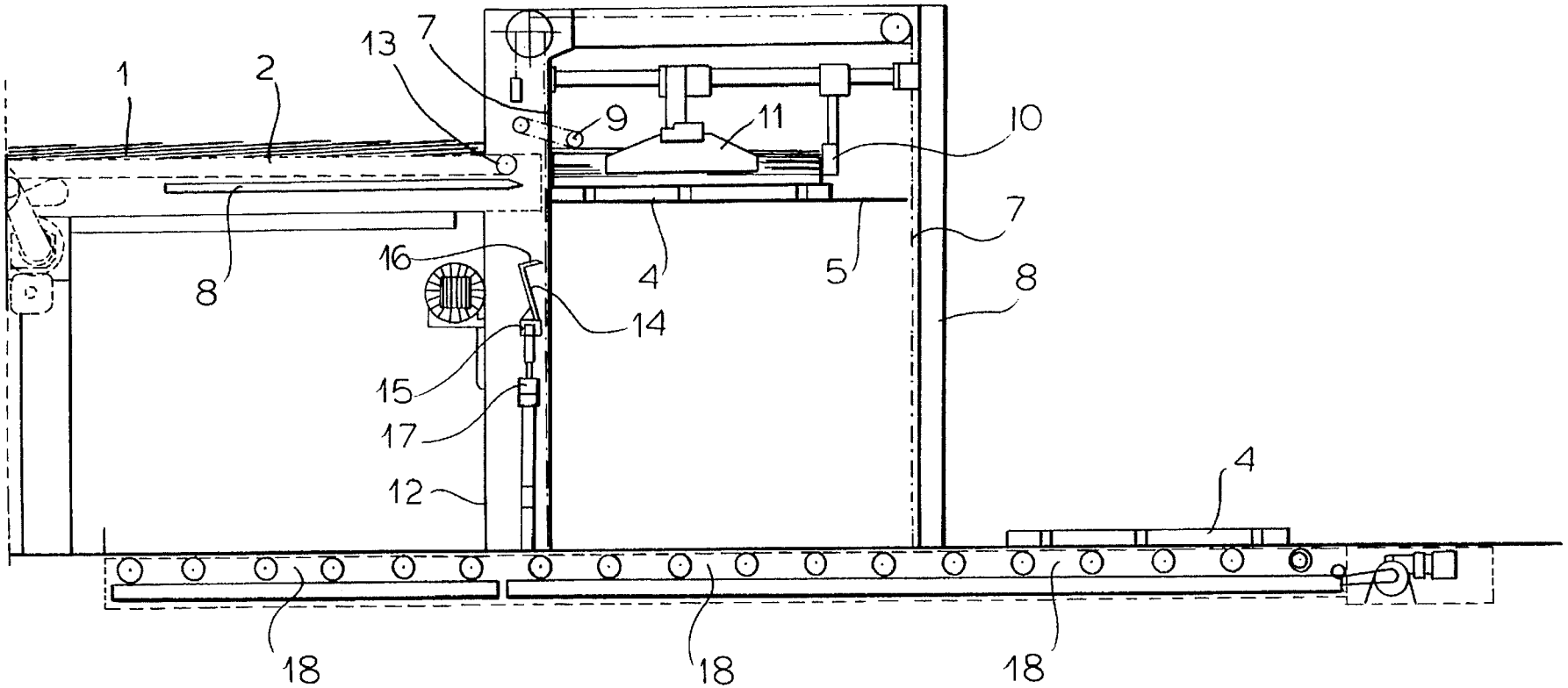

Then as shown in FIG. 6 the platform 5 raises the empty pallet 4 so that it is immediately underneath the platform 8. Finally as shown in FIG. 7 the platform 8 is retracted back upstream to deposit the short stack that was formed on it onto the fresh pallet 4 and vibration of the guide 10 is restarted. The fresh pallet 4 then starts to drop slowly as the stack 3 forms until the position of FIG. 1 is reached and the cycle is repeated.

It is also possible to construct the machine so that the auxiliary platform 8 can also be moved at least limitedly vertically by an actuator such as shown schematically at 26 in FIG. 1 so that the machine does not have to be slowed during pallet change, or so that the pallet can be changed more slowly. In this manner the drop of the sheets 1 to the stack formed on the auxiliary platform 8 can be limited to what the paper can tolerate without damage.

I claim:

1. An apparatus for stacking sheets, the apparatus comprising:

conveyor means having a downstream end spaced upstream in a horizontal transport direction from a stacking station for delivering the sheets continuously one after the other at a predetermined upper level in the direction to the station;

a main platform vertically displaceable in the stacking station between an upper position below the upper level and a lower position;

an auxiliary platform below the upper level and formed by a plurality of transversely spaced and parallel rods horizontally displaceable in the direction between an extended position in the station above the main platform, a retracted position upstream of the main platform, and between an upper position just below the upper level and a lower position therebelow;

a plurality of vertically extending separator elements between the conveyor means downstream end and the stacking station and having bent-over upper ends projecting downstream between the rods in the transport direction and displaceable between a separating extended position projecting into the station between the auxiliary platform and the upper level and engaged between trailing edges of the sheets in the station, a withdrawn position out of the station between the station and the conveyor means downstream end, an upper position with the upper ends just below the upper level, and a lower position with the upper ends level with the upper position of the auxiliary platform, each element having a vertical length greater than the vertical distance between the auxiliary platform and the upper level; and control means connected to the auxiliary platform and separator elements for, when a sufficiently tall stack is formed in the station, sequentially raising the elements into their upper positions and advancing the elements into their extended positions, lowering the elements into their lower positions while maintaining them in their extended positions to form in the stack a gap level with the auxiliary platform, advancing the auxiliary platform into its extended position so as to support the stack above the gap and retracting the elements to their withdrawn positions, lowering the main platform, removing the stack therefrom, and raising the main platform to its upper position, and withdrawing the auxiliary platform to its retracted position to deposit the stack on it onto the main platform.

2. The sheet-stacking apparatus defined in claim 1, further comprising a housing carrying the platforms and elements and having an upstream part between the station and the conveyor means downstream end, the housing forming a vertical guide face directed downstream and engaging trailing edges of the sheets in the stack, the vertical face being formed with throughgoing holes through which the auxiliary-platform rods can engage and therebetween with cutouts housing the separator elements.

3. The sheet-stacking apparatus defined in claim 1, further comprising means including an actuator and a stop for vertically displacing the elements between the separating position and a lower intermediate position immediately above the auxiliary platform.

4. The sheet-stacking apparatus defined in claim 1, further comprising means for limitedly vertically displacing the auxiliary platform.

5. The sheet-stacking apparatus defined in claim 1, further comprising a housing carrying the platforms and elements and having an upstream part between the station and the conveyor means downstream end, the housing forming a vertical guide face directed downstream and engaging trailing edges of the sheets in the stack and a horizontal face over which the sheets slide as they move from the conveyor means to the station, the vertical face being formed with throughgoing holes through which the auxiliary-platform rods can engage and therebetween with cutouts housing the separator elements.

* * * * *